United States Patent [19]

Bonigut et al.

[11] 4,169,484

[45] Oct. 2, 1979

[54] AUTOMATIC POOL CLEANER APPARATUS

[76] Inventors: Josef Bonigut, 2775 Tumwater Dr., Walnut Creek, Calif. 94598; Ramon E. Lindberg, 65 Monte Cresta Ave., Pleasant Hill, Calif. 94523; Peter K. Darm, 5278 Concord Blvd., Concord, Calif. 94521

[21] Appl. No.: 910,827

[22] Filed: May 30, 1978

[51] Int. Cl.[2] ..... B08B 3/02; B08B 9/08

[52] U.S. Cl. ..... 134/167 R; 4/172.15; 15/1.7

[58] Field of Search ..... 134/167 R, 168 R, 169 R, 134/172, 198; 15/1.7; 4/172.15, 172.16; 210/169; 239/229, 225, 251

[56] References Cited

U.S. PATENT DOCUMENTS

| | | | |
|---|---|---|---|
| 3,032,044 | 5/1962 | Pansini | 134/167 R X |
| 3,078,998 | 2/1963 | Blumenfeld | 210/169 |
| 3,108,298 | 10/1963 | Gelinas | 134/167 R |
| 3,392,738 | 7/1968 | Pansini | 134/167 R |
| 3,665,942 | 5/1972 | Moore | 134/167 R |
| 3,689,408 | 9/1972 | Edmiston et al. | 210/169 |
| 3,883,366 | 5/1975 | Blumenfeld | 4/172.16 X |
| 3,921,654 | 11/1975 | Pansini | 134/167 R |
| 4,023,581 | 5/1977 | Pansini et al. | 134/167 R |

*Primary Examiner*—Stanley N. Gilreath
*Attorney, Agent, or Firm*—Phillips, Moore, Weissenberger, Lempio & Majestic

[57] ABSTRACT

An automatic pool cleaner apparatus is disclosed including an elongated flexible conduit adapted to be connected at one end to a source of water under pressure and adapted to be connected at its other end to the rear of a body portion, said body portion having a plurality of water jet openings further defined on the rear thereof and positioned in a symmetrical relationship about the center line axis of said body portion, such that water discharged therefrom is directed to the rear substantially axially along the direction of said conduit, and further including means for maintaining said body portion in a submerged state, and means for causing said body to be oriented during its movements a substantial portion of the time in positions adjacent to the wall and bottom surfaces of said pool.

13 Claims, 4 Drawing Figures

AUTOMATIC POOL CLEANER APPARATUS

BACKGROUND OF THE INVENTION

The present invention relates to an apparatus for the automatic cleaning of swimming pools and the like, and more particularly, to an automatic pool cleaner of simple design that does not require a separate pump system or special hoses. The apparatus of the present invention operates to disturb the dirt and debris on the surface of the pool walls and bottom such that these particles are suspended in the water. The normal operation of the pool filter system is thus enabled to filter out this dirt and debris as part of its filtration of the pool water.

Devices for cleaning the surfaces of a swimming pool have in the past commonly included flexible sweep hoses that discharge water through jets to thereby disturb dirt and other debris which have accumulated on the pool surfaces. This material is thus placed in suspension in the water, as in the present invention, to enable the filtration thereof to remove the material from the pool. However, most such sweep hose systems have either required separate pump facilities, or have involved complex systems for the placement of these hoses. Examples of such systems include the pool cleaner disclosed in U.S. Pat. No. 3,689,408, wherein a car having a plurality of sweep hoses is caused to move along a track on the bottom of the pool, or the cleaner disclosed in U.S. Pat. No. 3,032,044, in which sweep hoses are coupled to a pipe that pivots about a boom floating on the surface of the water in the pool. Other types of automatic pool cleaners include devices wherein at some intermediate point on a hose, pool jets are located to cause the hoses to change direction in a random fashion, see, e.g., U.S. Pat. No. 3,392,738, or cleaners wherein mechanical means are used to modify the direction of the cleaner apparatus.

SUMMARY OF THE INVENTION

The present invention is an improved automatic cleaner for swimming pools and the like comprising flexible elongated conduit means adapted to be connected at one end to a source of water under pressure, propulsion means including a body portion adapted to be connected to the opposite end of said conduit means, and including a plurality of water jet openings for causing water forced therethrough to be substantially increased in velocity and momentum such that the body portion is moved through the water in an opposite direction thereby. The body portion is designed to remain adjacent to the wall and bottom surfaces of the swimming pool as it moves through the pool. A weight may be operatively associated with the body portion to further enable it to remain beneath the surface of the water. In the preferred embodiment, water enters the body portion via the conduit means attached to the rear of the body portion, and is reversed 180° and forced back out through the water jet openings at the rear of the body portion. Thus the action of the water pushes the body portion and conduit means through the pool. The body portion is shaped such that it glides through the water, the symmetrical orientation of the jets positioned at its rear enabling the body portion to move through the water in the opposite direction easily and in any random orientation. A wheel is mounted on the front of the body portion, offset from the centerline axis of said body portion, to enable the body portion to accelerate out of corners in the pool.

The body portion may further include means for altering slightly the direction of the body portion as it glides through the water. This means may include pressure biasing means, wherein the jet opening or openings on one side of the body portion are sized slightly larger or smaller than the jet or jets on the other side, such that a water pressure bias is generated thereby. This bias skews the direction of movement of the body portion through the water, to maximize contact of the body portion with the wall and bottom surfaces of the pool, and to aid in the ability of the body portion 22 to move out of corners existing in the pool. Further included are replaceable means for preventing the wear of the body portion as it comes in contact with the surface of said pool, said means further including means for scrubbing the surfaces of the pool as the body portion comes in contact therewith.

Therefore, a principal object of the present invention is to provide an automatic cleaning apparatus for swimming pools including a symmetrical propulsion system such that the apparatus may be propelled through the pool water on its top or bottom side, or in some other orientation while efficiently enabling continued cleaning action to be performed by the apparatus.

Another object of the present invention is to provide simple means for maintaining the cleaner apparatus in a submerged condition in moving contact with an adjacent pool wall or bottom surface a substantial portion of the time.

A further object of the present invention is to provide an apparatus including means for skewing the direction of movement of the apparatus and means for enabling the body portion of the apparatus to not become trapped in a corner of the pool.

These and other objects and advantages of the present invention will become more clear upon reference to the following description and accompanying drawings.

DESCRIPTION OF THE PREFERRED EMBODIMENT

Figure 1:
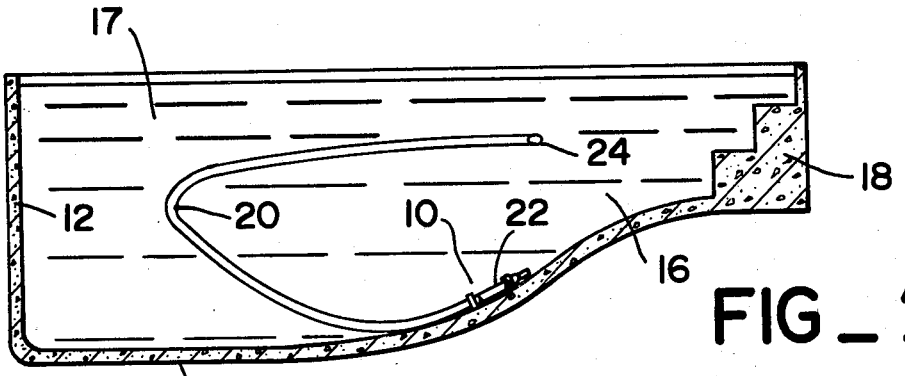
FIG. 1 is a longitudinal sectional view of a typical swimming pool showing the apparatus of the present invention in operation therein.

As shown in the drawings, the automatic pool cleaner apparatus is shown generally at 10, for use as a disturber of dirt and debris that has accumulated on the walls 12 or bottom 14 of a swimming pool 16, shown sectionally in FIG. 1, and filled with water 17. The automatic pool cleaner 10 of the present invention is designed to operate in any conventionally shaped pool or the like, and can reach all surfaces below the water line of the pool 16 including steps 18 and loveseats. The cleaner apparatus is designed to move in a random pattern at an approximate rate of three to five miles per hour.

As shown in FIG. 1, the cleaner apparatus includes conduit means 20 and a body portion 22. The conduit means 20 comprises a flexible elongated conduit of a length sufficient such that the body portion 22 can come in contact with all underwater surfaces of the swimming pool 16. The conduit means 20 is attached at one end thereof to a source of water under pressure. In the preferred embodiment, the conduit means 20 is attached to one of the return inlets 24 of the pool's filter system. Further, the conduit means 20 of the present invention comprises standard flexible hose. It is conventional and within the state of the art to provide a means for attaching such a conduit means 20 to the pool inlet 24. The advantage of using a pool inlet 24 is that no separate pump or other complex system facilities are needed as part of the present invention. Installation of the present invention is also made very simple, since only the one connection of the conduit means 20 to an inlet 24 is required to complete installation of the cleaner apparatus 10 in a given pool. Removal of the cleaner apparatus 10 is similarly made simple.

Figure 2:
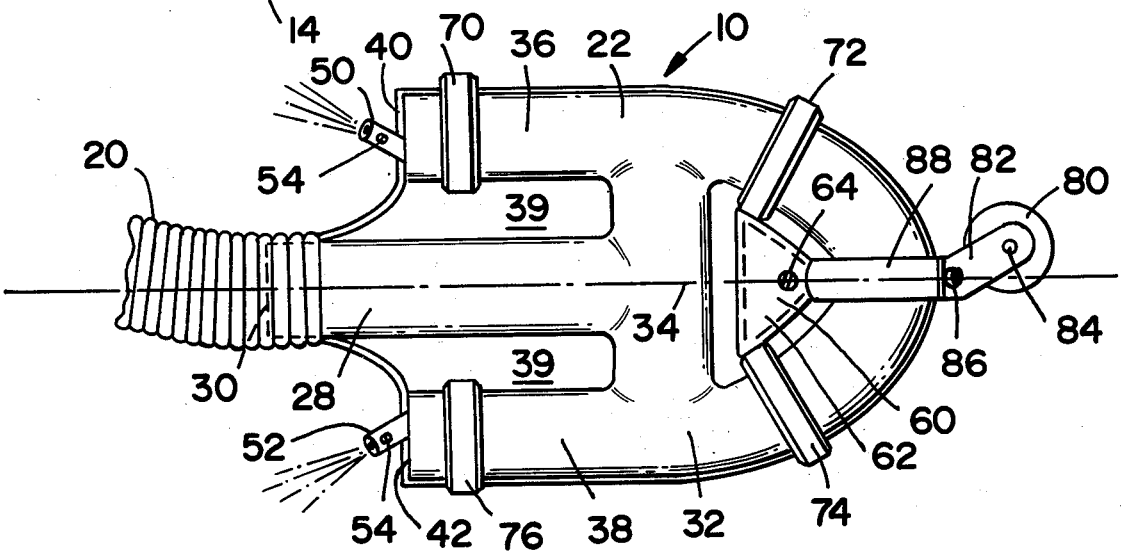
FIG. 2 is a top view of the body portion of the apparatus of the present invention.
Figure 3:
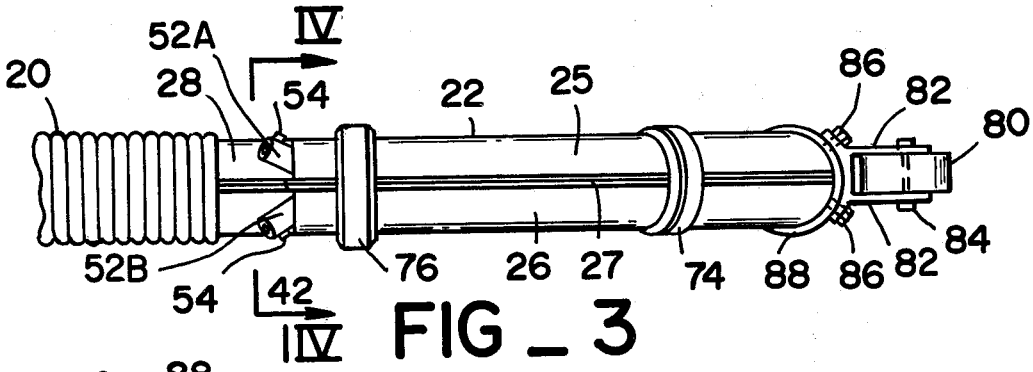
FIG. 3 is a side view partially broken away of the body portion.

In the present embodiment, the body portion 22 is composed of two identical halves of molded plastic, identified as 25 and 26 in FIG. 3. The seam between these two halves is shown at 27. When formed together, these two halves 25 and 26 define the body portion 22, including a tubular water entry cavity 28 therein, seen most clearly in FIG. 2. This cavity 28 is oriented along the center line axis 34 of the body portion 22 and is provided with connecting means 30 at its rear end thereof for enabling the conduit means 20 to be removably attached thereto. The tubular cavity 28 is a portion of a larger cavity 32 defined by the two halves 25, 26. Note that body portion 22 is also shaped such that it will glide through the water with a minimum of resistance. Equidistant from the center line axis 34 of the body portion 22, two additional tubular cavities 36 and 38 are defined as part of the cavity 32. These cavities 36, 38 include circular rear ends 40, 42 formed as a part thereof. Conventional flanges 39 are formed between the portions of body portion 22 defining said cavities 28, 36 and 38 to provide structural support therebetween, and for ease of manufacture.

A circular cavity is defined at 28 both to maximize water flow therethrough and as a convenience in forming connecting means 30 thereon. Cavities 36 and 38 are also formed to maximize fluid flow therethrough and further to enable easy replacement and retention of a means for preventing wear on said body portion 22. This means will be described in detail hereinbelow.

Figure 4:
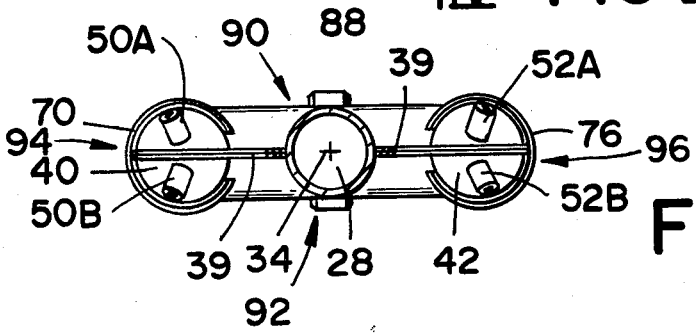
FIG. 4 is an end view of the body portion taken along the lines IV—IV of FIG. 3, illustrating placement of a preferred embodiment of water jet openings.

Fluid outlet means are provided on the ends 40, 42, and comprises a plurality of output ports or jet openings, shown as jet openings 50 and 52. These openings 50, 52 are placed in a symmetrical relationship equidistant from the center line axis 34 of the body portion 22. In the present embodiment, as seen in FIG. 4, two jet openings are provided in the body portion 22 on each side of the center line axis 34. These ports are identified as 50A and 50B and 52A and 52B. A plurality of output ports are provided so that water jets are operatively positioned as close as possible to an adjacent pool wall or bottom surface adjacent to which the body portion 22 is moving, whether the body portion 22 is oriented with the top up, the bottom up, or in some other orientation with respect to said surface. This is so that a maximum amount of debris lying on the adjacent pool surface will be disturbed into a state of suspension in the pool water. A plurality of output ports are also provided, as seen most clearly in FIG. 4, for ease of manufacture, since the seam 27 bisects the ends 40, 42 across their centers. In operation, therefore, water enters the rear of body portion 22 via cavity 28, and is reversed 180° and forced back out via ports 50, 52 to reactively propel the body portion 22 through the water thereby.

To ensure that a maximum amount of fluid is discharged towards an adjacent pool surface independent of the orientation of the body portion 22 as it moves along said surface, the four jet openings 50 and 52 may be further defined such that water exiting from each jet opening 50, 52 is directed slightly up and away from the center line axis 34 of said body portion 22. This jet 50, 52 orientation is best viewed in FIG. 4.

Thus, if we label the sides of body portion 22 as being the top side 90, bottom side 92, left side 94, and right side 96, then when an adjacent pool surface is closest to the left side 94 of body portion 22, the orientation of jets 50A and 50B will cause a significant amount of water to be discharged against said surface. Similarly, if the pool surface is closest to the bottom side 92 of body portion 22, jets 50B and 52B will be the operative jets, and their orientation will enable the water discharged therefrom to be directed to a significant extent against said pool surface. Therefore, the body portion 22 can move adjacent to a wall or bottom surface 12, 14 of the pool 16 in any orientation and still discharge a significant amount of water against the pool surface, to again maximize the agitation of debris which may have accumulated thereon.

A second advantage of tilting each jet 50, 52 up and away from the center line axis 34 of the body portion 22 is that it enables the water discharged from the jet to clean a wider path along the adjacent pool surface. This is because the water is discharged in a direction that is different from the forward direction of the body portion 22. The discharged water is therefore caused to be directed across a larger area due to the increased resistance felt by the water in not being directed completely opposite to the direction of body portion 22 movement. Consequently, for example, where a 12" wide path was cleaned when the jets are oriented directly opposite to body portion 22 movement, an 18" wide path may be cleaned with the jet tilted slightly away from this orientation.

The jets 50 and 52 are not tilted so far from the center line axis 34 of body portion 22, however, to the extent that the forward momentum of the pool cleaner apparatus 10 is significantly reduced. If the body portion 22 moves too slowly, overall efficiency is reduced, since the amount of increased path width cleaning is not large enough to exceed the reduced area covered in a forward direction by the body portion 22. Further, if the two top or bottom jets, e.g., jets 50B and 52B, when the pool surface is adjacent to the bottom side 92 of the body portion 22, are tilted too far away from each other, a strip in the center right under the body portion 22 will remain uncleaned.

The two halves 25, 26 of the body portion 22 further define a cavity 60 wherein may be placed a weight 62. The weight 62 is designed to insure that the body portion 22 of the present invention will not have a density less than the density of water. Consequently, the body portion 22 will not float on the surface of the water in the pool 16. This enables use of the present invention even when a pool cover has been placed on the pool 16. In the preferred embodiment, the weight 62 is a stainless steel weight of approximately 150 grams. To prevent separation of the two halves 25, 26 of the body portion 22 in the area adjacent to the weight 62, a secondary fastening means is provided. In the present embodiment, this fastening means comprises a plastic nut and bolt 64 which is operatively positioned to extend through a portion of the weight 62 and to fasten on the outside of the two body portion 22 halves 25, 26.

The body portion 22 may further include means for altering slightly, or skewing, the direction of the body portion 22 as it glides through the water, to more fully guarantee that the body portion 22 covers all of the wall and bottom surfaces of the pool in a random fashion during its movement. It also enables the body portion 22 to move out of pool 16 corners. One means for accomplishing this movement skewing of the body portion 22 is to size the jet openings 50A and 50B slightly differently from the jet openings 52A and 52B, e.g., if the openings 50 are slightly larger than the openings 52, the force of the water exiting through the jets 50 would be slightly higher than that of water exiting through the jets 52, to thereby provide a slight pressure biasing means on the body portion 22. This pressure biasing means would thus cause the body portion 22 to skew in its movement slightly to the side on which the jets 52 are placed. The jets may be made so that they are adjustable from fully open to fully closed. In the present embodiment, this function would be provided by means of a set-screw 54 operatively positioned on each said jet 50, 52.

A further means are provided to help prevent the body portion 22 from becoming lodged in a corner or other recess in the pool 16. This means comprises wheel 80, which is attached off-set to the front of the body portion 22 by means of fingers 82 and an axle 84. Without such rotating means, a higher coefficient of friction is experienced by the body portion 22 in such corners. The finger 82 are attached to the body portion 22 by means of stainless steel screws 86 which are attached to a ring 88 of high molecular plastic, which is snapped in place on the body portion 22 at its front end. Thus, in operation, as the body portion 22 comes in contact with a corner, the wheel 80 causes the body portion 22 to accelerate out of this corner quickly and efficiently.

The pressure biasing means is also set to improve the ability of the cleaner 10 to move out of corners in conjunction with wheel 80. Wheel 80 is off-set to the side of the body portion 22 in which the jets are adjusted to provide a lesser flow of water than the opposite jets. Thus, as seen in FIG. 2, the jets 50A and 50B are adjusted to provide this lesser flow. Consequently, with the wheel 80 as the pivot point, the distance to jets 52A and 52B is greater and the flow of water from these jets, i.e., their dynamic force, is higher, to increase in two ways the moment of force which can be applied at the wheel 80 pivot point. Therefore, with this larger net moment, it is much easier for the cleaner 10 to move out of a corner in the pool 16.

Finally, the present invention further includes replaceable means for preventing wear on the body portion 22. In the present embodiment, the body portion 22 is composed of ABS plastic material. This material, if it is allowed to be continuously in contact with a pool surface during movement of the body portion 22, quickly becomes worn through, allowing water to escape from cavity 32. This would damage or completely destroy the operation of the present invention. Consequently, rings of a material such as high molecular weight plastic are replaceably attached to the body portion 22, as shown in FIG. 2 at 70, 72, 74, and 76, and as also illustrated in FIG. 4. These rings are replaceable and snap in place along tubular portions of the body portion 22. Such rings wear at a much slower rate than the associated body portion 22 plastic material, and further provide the advantage that when they come in contact with a surface of the pool, they provide a scrubbing action on these surfaces, thereby assisting in the more efficient removal of dirt and debris from these surfaces. The rings 70–76 also "hone" rough spots on the walls and bottom surfaces of the pool 16 making them smoother and less likely to accumulate such dirt and scum.

It is to be understood that the foregoing description is merely illustrative of a preferred embodiment of the invention and that the scope of the invention is not to be limited thereto but is to be determined by the scope of the appended claims.

What is claimed is:

1. An automatic cleaning apparatus for swimming pools and the like comprising:

flexible elongated conduit means connected at one end to a source of water under pressure;

propulsion means comprising:

(i) a body portion, including a symmetrical top and bottom side, said body portion operatively connected to the second end of said conduit means, said conduit means acting to communicate water under pressure to said body portion; and (ii) fluid outlet means operatively connected to, and in fluid communication with, said body portion, comprising a plurality of output ports positioned in a symmetrical relationship on opposite sides of said conduit means and oriented such that water discharged therethrough is directed substantially axially of said second end of said conduit means in a direction opposite from the direction of water flow in said conduit means, said propulsion means operative to move said body portion and said conduit means in a random manner adjacent to the surfaces of the pool; and means for redirecting the direction of movement of said body portion out of a corner or recess in said pool comprising a wheel operatively attached to the leading end of said body portion and positioned offset to one side thereof.

2. The apparatus of claim 1, wherein said body portion is formed from two identical halves of plastic material sealed together in a conventional manner.

3. The apparatus of claim 1 further comprising replaceable wear means comprising a plurality of elements positioned in a spaced relationship on said body portion such that no part of said body portion can normally contact a pool surface during movement of said body portion adjacent thereto.

4. The apparatus of claim 3 wherein each said replaceable wear means element comprises a ring of high molecular weight, wear resistant plastic formed in a shape such that it can be snapped in place at a selected point on said body portion.

5. The apparatus of claim 1 further comprising means for maintaining said body portion in a normally submerged condition within said pool.

6. The apparatus of claim 1 further comprising means for continuously skewing the direction of movement of said body portion a constant amount in response to the flow of water through said output ports.

7. The apparatus of claim 6 wherein said means for skewing comprises pressure biasing means including means for causing a reduced flow of water out of said output port or ports on one side of said body portion as compared with the flow of water out of said port or ports on the other side of said body portion.

8. The apparatus of claim 6 wherein said means for skewing comprises pressure biasing means including means for manually adjusting the flow of water discharged from one or more said output ports.

9. The apparatus of claim 1 wherein said means for redirecting the direction of movement of said body portion out of a corner or recess further comprises:

means for skewing the direction of movement of said body portion in response to the flow of water through said output ports, including means for reducing the flow of water out of said port or ports positioned on the side corresponding to the side on which said wheel is offset.

10. An automatic cleaning device for swimming pools and the like comprising:

elongated flexible conduit means; and a body adapted to glide through water and connected at its rear end to a source of water under pressure by means of said elongated flexible conduit means, said body comprising:

means for maintaining said body in the submerged condition within said pool;

two water jet openings formed on the rear of said body and formed symmetrically on opposite sides of said conduit means;

cavity means in said body for enabling fluid communication between said conduit means and said water jet openings, a jet of water being discharged thereby from each of said jet openings to enable said body to be moved thereby in an axial direction with respect to said conduit means;

means for redirecting the direction of movement of said body out of a corner or recess in said pool comprising a rotating means operatively attached to said body in a position offset to one side of the leading end thereof; and means for directing said body along a path a small angle off of a path defined along the center line axis of said body.

11. An automatic cleaning apparatus for swimming pools and the like comprising:

flexible elongated conduit means connected at one end to a source of water under pressure; and propulsion means comprising:

(i) a body, including an input cavity operatively connected along its center line axis to said conduit means and two output cavities in fluid communication with said input cavity, said output cavities positioned on opposite sides of said input cavity, said body defined in a shape to facilitate gliding of said body through water; and (ii) fluid outlet means in each said output cavity including two output water jet openings positioned to discharge water in a direction substantially opposite to the direction of the flow of water in said conduit means, and further positioned to discharge water slightly up and away from the center line axis of said input cavity.

12. The automatic cleaning apparatus of claim 11 further comprising:

means for skewing the direction of movement of said body in response to the flow of water through said output ports, and including at least one jet opening on one output cavity defined to have a lesser flow of water discharged therethrough; and means for redirecting the direction of movement of said body out of a corner or recess in said pool comprising a wheel operatively attached to the leading end of said body and positioned offset to one side thereof, and including said lesser flow jet opening defined on the output cavity positioned on the side corresponding to said wheel offset.

13. An automatic cleaning apparatus for swimming pools or the like having a filtering system and a pump for drawing water from the pool, through said filtering system, and back into the pool via a pool return inlet, said apparatus comprising:

flexible elongated conduit means;

means for connecting one end of said conduit means to said pool return inlet;

a body portion, including a symmetrical top and bottom side, said body portion operatively connected to the second end of said conduit means, said conduit means acting to communicate water under pressure to said body portion; a plurality of water jet openings formed on the rear of said body portion and formed symmetrically on opposite sides of said conduit means and oriented so said water discharged therefrom is directed substantially axially of said second end of said conduit means; and means for redirecting the direction of movement of said body portion out of a corner or recess in said pool comprising a wheel operatively attached to the leading end of said body portion and positioned offset to one side thereof.

* * * * *